United States Patent [19]

Leto

[11] 4,185,753

[45] Jan. 29, 1980

[54] DEVICE FOR DISPENSING END WRAPS

[75] Inventor: Maria J. Leto, Ramsey, N.J.

[73] Assignee: Poly Pak, Inc., Ramsey, N.J.

[21] Appl. No.: 826,346

[22] Filed: Aug. 22, 1977

[51] Int. Cl.[2] ..... B65D 5/72

[52] U.S. Cl. ..... 221/45; 221/62; 221/49; 221/185; 206/233

[58] Field of Search ..... 221/45–63, 221/33, 185, 197; 220/63, 67; 206/222, 233, 39.3, 39.7, 39.8

[56] References Cited

U.S. PATENT DOCUMENTS

| | | | |
|---|---|---|---|
| 1,745,553 | 2/1930 | Mitmann | 24/DIG. 16 |
| 2,087,181 | 7/1937 | Conway | 221/185 X |
| 2,101,307 | 12/1937 | Bodette | 221/59 |
| 2,122,637 | 7/1938 | Colburn | 221/60 |
| 2,347,823 | 5/1944 | Goodman et al. | 221/185 X |
| 2,775,093 | 12/1956 | Kundert | 24/208 A |
| 3,395,830 | 8/1968 | Buttery | 221/63 |
| 3,624,791 | 11/1971 | Taub | 221/59 |

*Primary Examiner*—David A. Scherbel
*Attorney, Agent, or Firm*—Ronald G. Goebel

[57] ABSTRACT

This invention provides a device for dispensing flexible sheets of absorbent paper or other fiberous material. The sheets are preferably end-wrap papers used in the art of cosmetology and particularly for permanently setting waves in hair. The device employs a container with a slit in the top. The preferred device is of triangular cross-section having a width less than the width of a given end-wrap sheet. The end wraps are withdrawn from the container through the slit such that, the removal of one end wrap causes the next lower end wrap to be partially withdrawn through the slit. The container can be removably fastened to a wrist bracelet which is adjustable to fit a user's arm.

12 Claims, 10 Drawing Figures

DEVICE FOR DISPENSING END WRAPS

BACKGROUND OF THE INVENTION

This invention relates to an apparatus and a method for dispensing flexible sheet material, particularly end wrap papers used in cosmetology. A novel dispenser containing a plurality of interposed sheets of material from which the sheet material may be removed, one at a time, is provided and which dispenser is mountable on a human arm or other convenient surface by use of an adaptable mounting device.

In the hair waving industry it is customary for a cosmetologist when giving a permanent wave treatment to the hair of a customer, to utilize small rectangular sheets of flexible, porous absorbent paper or fabric which retains a permanent solution in contact with the hair to which it has been applied. This is accomplished by the cosmetologist after a plurality of strands of hair are segregated from the remainder of the customer's hair and folded inside one of the retention end wraps. The segregated strands of hair, which have been enclosed in the end wrap paper are rolled or coiled over a curling device, commonly known as a roller. During this hair-waving operation, it is customary to apply a chemical preparation to the hair and the end wrap papers, thereby providing a treatment to the strands of hair designed to yield greater permanence from the setting of the hair. Frequently, the cosmetologist will pretreat the hair with a netralizing agent to protect previously treated portions of the hair. The primary purposes of the end wrap papers is to maintain the strands of hair which have been segregated as a unit as they are placed on the roller, to retain a greater quantity of the chemical preparation in contact with the strands of hair, and to provide a cushion between the strands of hair and the rough surface of the roller.

End wraps are commercially supplied as small flat papers superimposed one upon another and packed in boxes made of cardboard or paper, which boxes are generally utilized with the top removed. Normally, the cosmetologist must situate the box of end wrap papers on a counter or shelf adjacent to the work area. When an end wrap paper is to be utilized, the cosmetologist must first segregate the strands of hair to be rolled and then turn from the customer to procure both an end wrap paper and a roller while still grasping the segregated strands of hair. This operation is most commonly performed while the cosmetologist's hands are wet from a previous application of the liquid pretreatment and/or permanent preparation and is further complicated by the cosmetologist's frequent inability to withdraw only a single end wrap paper from the presently designed end wrap containers. Because of the lightweight characteristics of both the end-wrap papers and container, the container is often pulled along or lifted with an end paper when the cosmetologist attempts to remove a single end paper, thus causing spillage of the remaining papers in the container or, at the least, transfer of the container to an inconvenient position for the removal of the next end paper.

In the past, several dispensers for flexible sheet materials have been described which in one way or another attempt to solve the problems described above.

In U.S. Pat. No. 2,087,181 to Conway, a dispensing container for housing interlocked sheets for removal one at a time is described which is especially adapted for hairdressers. The container is readily clamped to a hair curler for easy access thereto by the beautician and comprises a case having a discharge slot for removal of the sheets, a removable cover hinged to the side of the case opposite the discharge slot, a spring secured to the inner face of the cover which bears against a package of interlocking sheets stored within the case, and a pair of resilient clamps secured to the outer face of the cover at right angles to each other for grasping and holding the case on a roller.

In U.S. Pat. No. 2,347,823 to Goodman et al, a dispensing container for sheet material is described comprising a rigid container having an opening at the top and elongated finger-like members partly closing the opening and a resilient means such as spring and movable plate for constantly pressing a stack of sheet material against the top opening and fingers. The container is preferably irregularly shaped, the dispensing end being greater in height than the rear end. The container can be worn on the arm of the operator by constructing the base of the container in a curve to conform with the curve of the wrist and by attaching a strap and buckle to be clasped about the wrist.

In U.S. Pat. No. 3,826,407 to Keating, a complicated end wrap dispenser adapted to be worn around the wrist is described, the base portion of which has a plurality of sidewardly extending arms. Tongue members connected to the ends of the arms mate with slots in the base. Four upwardly extending arms which are attached to the sidewardly extending arms, are positioned along the sides of a rectangular pattern to form a receptacle for the end wraps and are spaced to provide easy access to the top sheet for removal therefrom without disturbing the next subadjacent sheet. The above described dispensers, although constituting an improvement over lightweight containers in which end papers are packaged, are basically large, cumbersome and rather complicated in design. The containers of Conway and Goodman et al, for example, require spring means to force available sheets toward their respective discharge slots or openings. In Conway, the sheets must be loaded in the dispenser at the end opposite the discharge slot. Moreover, since hair-treating solutions used in modern treatments attach many required materials, the clamps of Conway attached to a roller which is in contact with such solutions, would be subject to wear and corrosion after repeated use. Both the Goodman et al and Keating dispensers are complicated and cumbersome; the Goodman et al device being characterized by a large irregularly-shaped container, a plurality of fingers and a curved base and the Keating device by a complex arrangement of interconnecting upwardly and sidewardly extending arms and flanges. Further, these devices are difficult to load with sheets and do not particularly address the problem of dispensing only one sheet of material at a time.

The present invention on the other hand, provides a dispenser for flexible sheet material, particularly end wraps, which is simple in design and construction, does not employ the use of springs or any other resilient means, is easy to load, can be conveniently adapted to be worn about the arm and most importantly is particularly designed for one-at-a time removal of sheet material.

The present invention has as one object, the provision of a container for end wrap sheet materials which will permit the withdrawal of a single end wrap paper at a time.

Another object is to provide a dispenser of end wrap papers from which the cosmetologist can withdraw one end wrap paper notwithstanding the fact that the cosmetologist's hands are wet from previous applications of liquid permanent waving preparations.

A further object of this invention is to provide a small lightweight end wrap dispenser which can be comfortably attached to the arm of the user and which will not rotate about the arm or wrist.

An even further object of this invention is to provide an end wrap dispenser which is easily refillable.

A still further object of this invention is to provide an end wrap dispenser which imparts an upward thrust of end wrap papers toward the dispenser opening.

SUMMARY OF THE INVENTION

The present invention provides a device for dispensing a plurality of flexible sheets adapted to be worn on the human arm comprising;

(a) a container for said sheet material comprising a removable top member and a base, said top member having an opening for removing a flexible sheet from said container.

(b) a plurality of folded flexible sheets stacked within said container, each sheet folded to form a top and bottom fold; the bottom fold of each sheet being between the top and bottom folds of the immediately sub-adjacent sheet and the top fold of each sheet being between the top and bottom folds of the immediately super-adjacent sheet, the top fold of the uppermost sheet extending through said opening.

(c) a solid projection extending outwardly from said base; and (d) a flexible member adapted to fit around the human arm or portion thereof and having at least one recessed identation adapted to accept said solid projection in close fit therewith.

In a particularly preferred embodiment of this invention a dispensing device having a triangular cross-section with dimensions smaller than the end wrap paper to be dispensed is provided. Such device is easily loaded and when in the operating position distorts the end wrap papers to conform to the triangular shape of the device thus imparting an upward thrust of the end wrap stack towards the opening for easy removal.

DETAILED DESCRIPTION OF THE PREFERRED EMBODIMENTS

Figure 1:
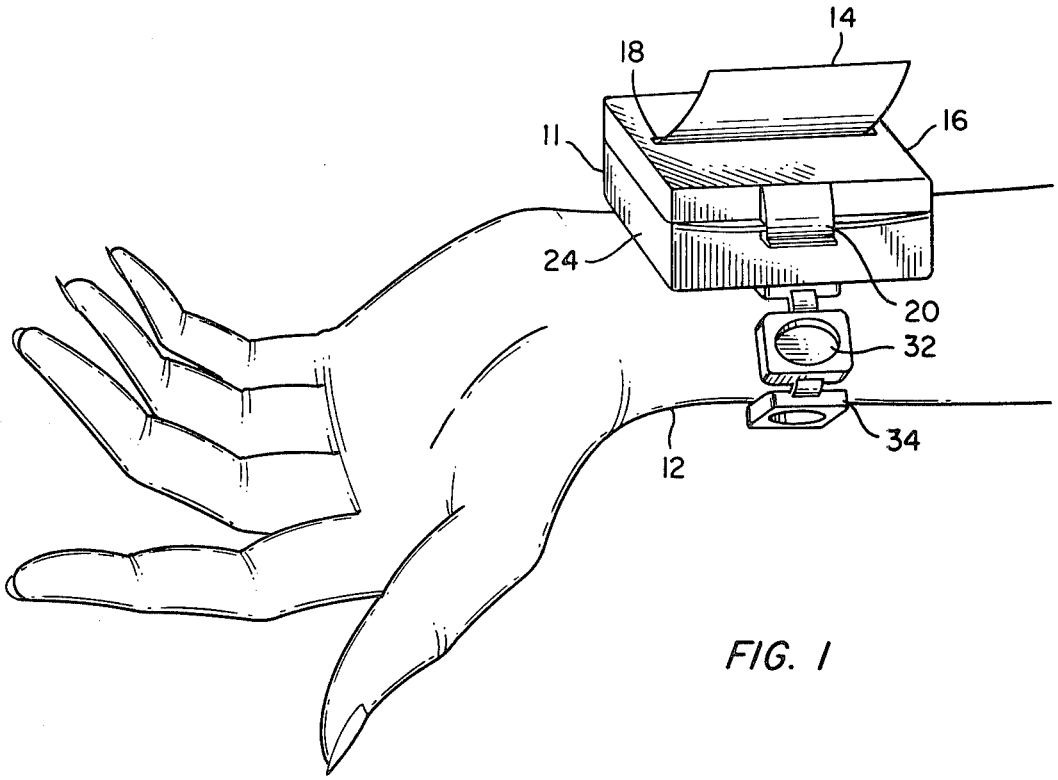
FIG. 1 is an isometric view of the end wrap paper dispenser attached to the user's arm.

Referring to FIG. 1 an end wrap dispenser 11 is shown which is designed to be attached to the human arm 12 by way of a wrist bracelet 34. An end wrap container 24 is fastened to the wrist bracelet 34 and the container top 16, in which there is a slit 18, is removably mounted on the container 24. The top fold of sheet material 14 is partially withdrawn through slit 18 such that the sheet material can be fully withdrawn by grasping the exposed portion and pulling it through the slit 18.

Figure 2:
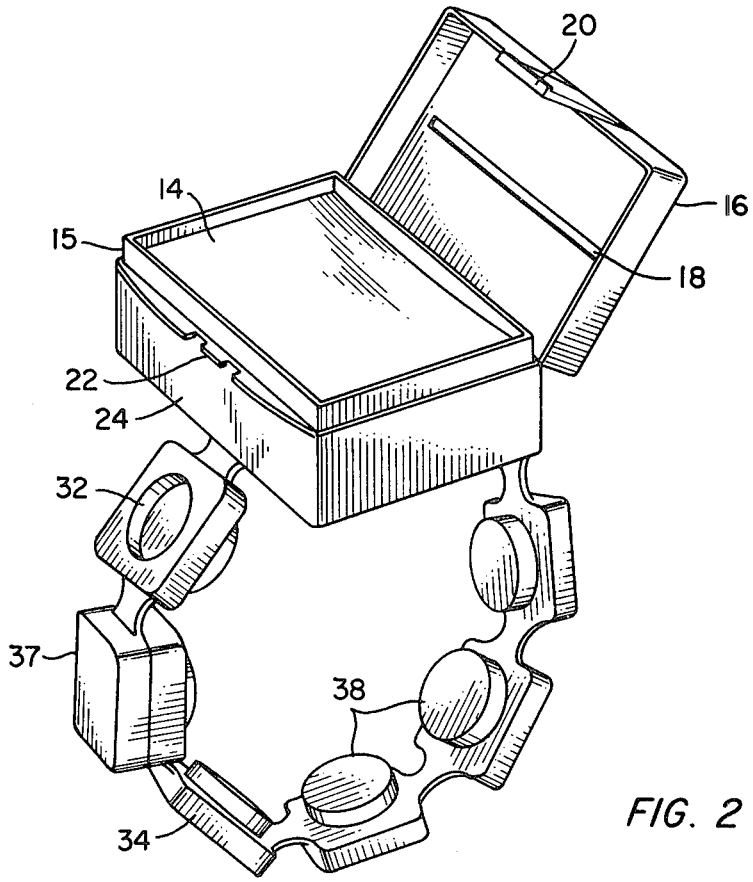
FIG. 2 is an isometric view of the dispenser with the top in an open position revealing a stack of sheet material contained therein.
Figure 3:
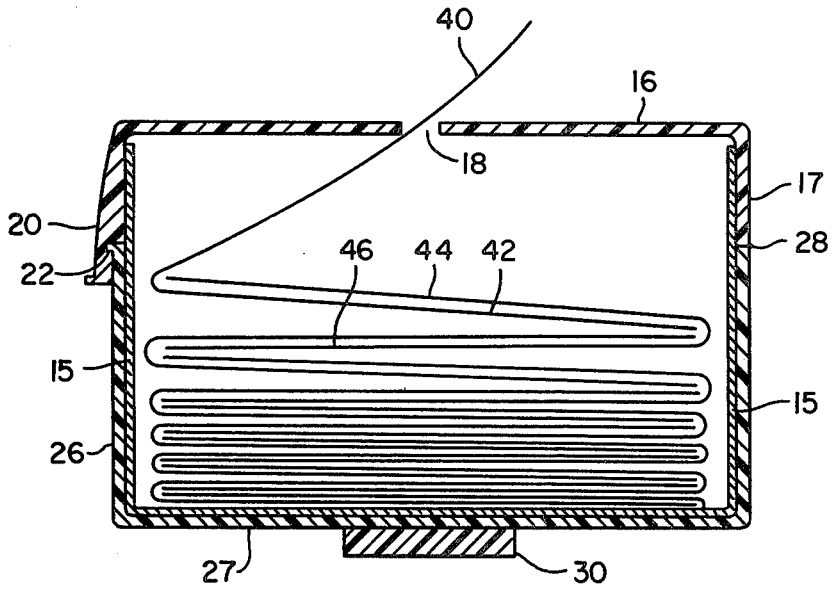
FIG. 3 is a section 3—3 through the container and container top showing the folding and stacking of sheet material.

Referring to FIG. 2 and FIG. 3, the sheet material 14 is folded and creased such that each sheet has a top fold 40 and 44 and a bottom fold 42 and 46. The sheet material 14 utilized is rectangular thin gauge porous, absorbent fibrous or paper material which is stacked vertically and in a position such that the top fold 40 passes through slit 18. The top fold of the immediately sub-adjacent sheet 44 is positioned between the top fold and bottom fold 42 of the super adjacent sheet. This configuration of vertical stacking is generally known as interpositioned C folds and such interpositioning is repeated until the vertical stack of sheet material is of sufficient depth to be approximately equal to the depth of a sheet material holder 15 which is a disposable, light-weight rectangular box constructed preferably of a common carboard material. The sheet material holder is removably inserted into the container 24. The sheet material 14 may be treated or coated with dry or powdered chemical to accomplish any of a number of results which might be desired by the cosmetologist. Such pretreatment of the sheets may include chemicals for neutralizing hair conditions of alkalinity or acidity as well as other functions. The pretreatment of the sheets will eliminate that step in the permanent wave procedure which makes hair treatment a separate operation.

The container 24 consists of a rectangular container base 27 and four rectangular container sides 26 which are preferably injection molded into a single unitary structure of moldable, rigid or semi-rigid synthetic polymer composition. The dispensing device and method also contemplate the utilization of a container top 16 sized to fit cooperatively with the container 24 and is to remain held in a semi-permanent closed position as reflected in FIG. 3. The container top 16 is preferably, but not necessarily composed of like material and manufactured in the same manner as the container 24.

The container top 16, as shown in FIG. 2 and FIG. 3 can be permanently fastened to the container 24 along one edge by a rotational fastener 28 which consists of an integrally formed flexible connecting strip which, by injection molding, forms the container top 16 and container 24 into a single integral unit of similar composition and which allows rotational movement of the container top 16 from the open position reflected in FIG. 2 to the closed position reflected in FIG. 3. The container top 16 includes within, a slit 18 through which the flexible sheet material 14 can pass and contains a first locking means 20 which works in cooperation with the second locking means 22 to provide a semi-permanent fastening when the container top 16 is in its closed position.

In its preferred embodiment the first locking means is constructed of the same material as and in the same manner, as the container top 16 and the container 24, being semi-rigid synthetic material which is injection molded as shown in FIG. 3. the first locking means 20 is designed to flex into the second locking means 22 which is a ridge on the container 24 such that when the container top 16 is in the closed position the first locking means 20 in cooperation with the second locking means 22 prevents rotational movement of the container top 16 in relation to the container 24.

An alternative means of preventing rotational movement of the container top 16 could be the substitution for the first locking means 20 and the second locking means 22 of any semi-permanent adhesive or mechanical fastening device.

A stack of sheet material 14 is folded, creased and positioned as shown in FIG. 3 inside the sheet material holder 15 which is inserted in the container 24, the top fold 40 passing through slit 18. The user of the apparatus and method then closes and fixes the container top 16 by use of the first locking means 20 and second locking means 22 and withdraws the top sheet material by grasping fold 40 and pulling it through slit 18 which simultaneously moves the top fold of the sub-adjacent sheet 44 through slit 18. The operation may be repeated until all sheets are removed.

Figure 4:
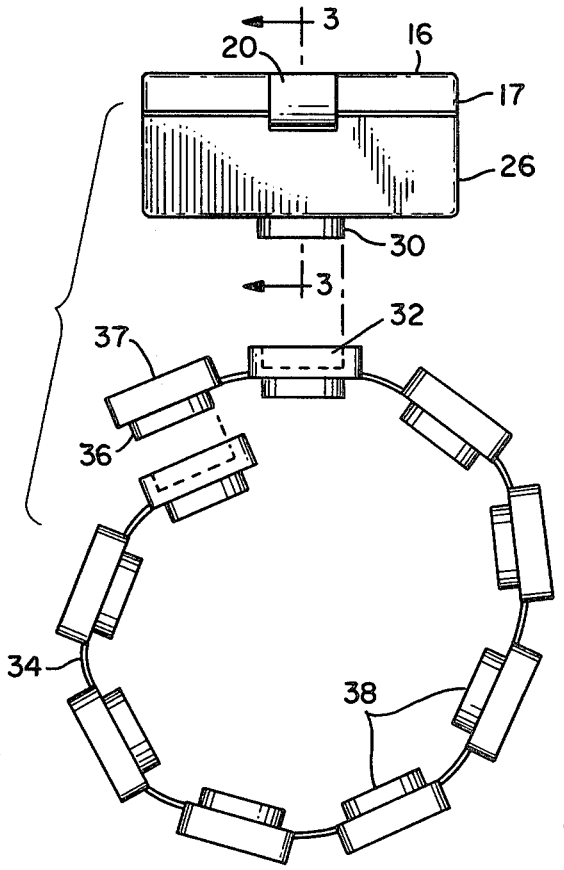
FIG. 4 is an end view elevation showing the method of cooperation between the container and bracelet and further showing the method of adjusting bracelet circumference.

FIG. 4 shows the container 24 fastened to the wrist bracelet 34. A first connecting means 30 which is a circular projection, projecting outward from the container base 27 is shown which is injection molded of the same synthetic polymer material and in the same manner as the container base 27. The wrist bracelet 34 is constructed of a similar semi-flexible polymer material and molded in a configuration designed to fit the curvature of a user's wrist, consisting of a molded bracelet 34 of the same material as the container 24 and container top 16 see also FIGS. 5 and 6. The bracelet 34 is molded such that it contains a plurality of second connecting means 32 positioned linearly along the inside of the bracelet. The second connecting means 32 is a recessed indentation shaped and sized to cooperate with the first connecting means 30 and the bracelet connecting element 36 so that when the first connecting means 30 or the bracelet connecting element is inserted by non-destructive force into the second connecting means 32, a pressure bond is created to prevent relative movement between the connected parts. The bracelet circumference is adjusted to fit the user's wrist by inserting the bracelet connecting element into the appropriate second connecting means 32. The bracelet 34 is fastened to the container 24 by inserting the first connecting means 30 into any then available second connecting means 32. Fastened to the inside curvature of the bracelet 34 is a bracelet lining 38 consisting of a soft non-slip fabric or synthetic material designed to serve as a cushion and prevent rotation of the bracelet 34 in relation to the user's wrist 12. Any of a number of alternative fastener methods or means which would join the container 24 to the bracelet 34 and prevent relative movement as a substitute for the herein described first and second connecting means, 30 and 32. As an alternative would be unitary manufacture of the bracelet 34 and container 24 as a single piece.

Figure 7:
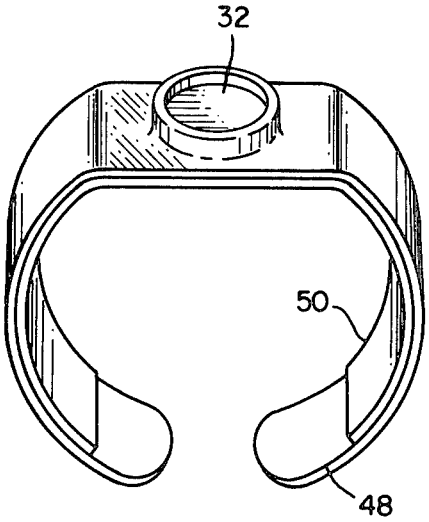
FIG. 7 is an isometric view of an alternate embodiment of the wrist bracelet.

FIG. 7, shows an alternative embodiment of the wrist bracelet in which the wrist bracelet 48 is a solid resilient synthetic material shaped such that the resilient quality of the material used creates sufficient pressure upon the user's wrist to assure no movement of the wrist bracelet 48 in relation to the wrist 12. The wrist bracelet 48 must be sufficiently resilient to allow the user's wrist to pass through the separated ends of the bracelet while thereafter holding the bracelet snuggly on the users wrist. The wrist bracelet 48 has fastened thereto a soft, non-slip synthetic or fabric lining 50 of material designed to serve as a cushion while preventing slipage or rotation.

Figure 8:
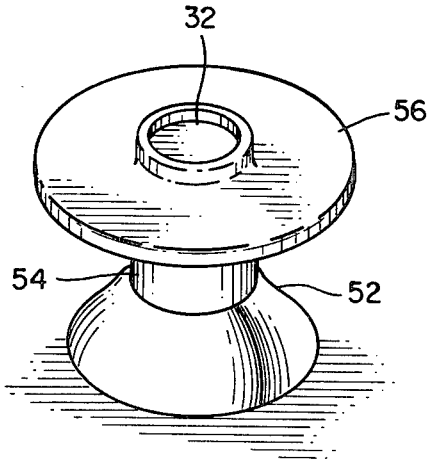
FIG. 8 is an isometric view of an alternate mounting means used to fasten the device on a flat surface.

FIG. 8, reflects a platform means for dispensing sheets from a flat surface rather than from a wrist bracelet as reflected in FIG. 1. A second connecting means 32 as indicated above in conjunction with the description of the wrist bracelet 34 is shown which second connecting means 32 is attached to a platform 56, vertical shaft 54 and suction cup base 52 and which may then be attached to any flat surface thereby providing a semi-permanent dispenser location.

Figure 9:
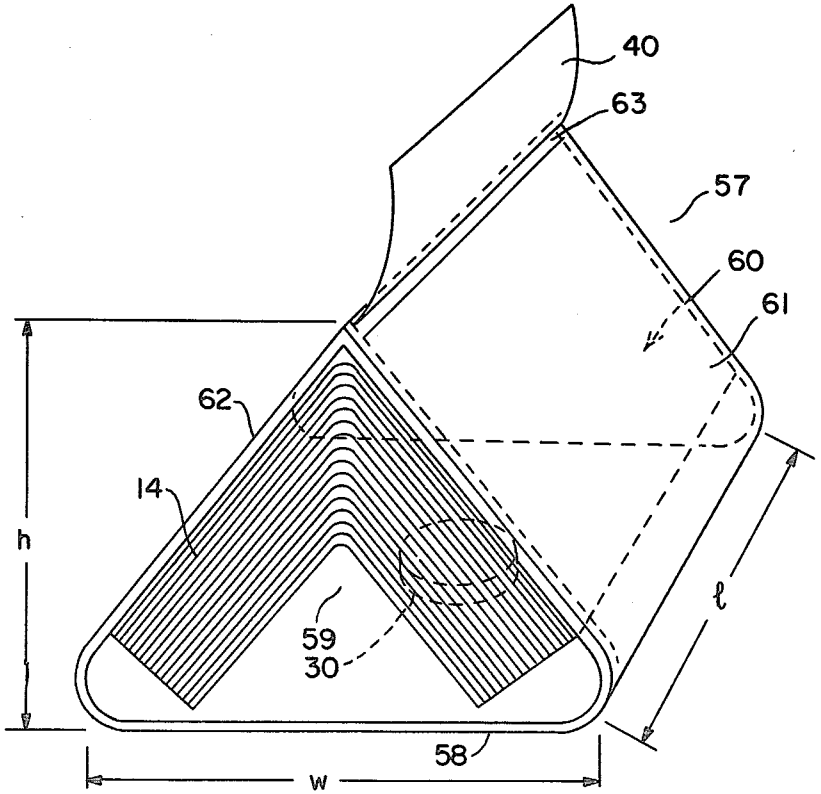
FIG. 9 is an isometric view of the preferred end wrap dispenser of the invention having a triangular cross-section.

FIG. 9 shows the preferred embodiment of the present invention which is an end wrap dispenser of triangular cross-section. The triangular dispenser is shown generally by 57 and consists of a base 58 having width w and length l, a pair of primary triangular face members 59 and 60 extending perpendicularly from said base and a pair of side members 61 & 62 mounted along the length l of base 58 and extending to the side of primary triangular face members 59 and 60. The base 58, face members 59 and 60 and side members 61 & 62 can be made of any of the materials hereinbefore mentioned. Preferably, base member 58 and primary triangular face members 59 and 60 are made integral with one another. One of the side members 61 or 62 is removably or hingedly connected to an edge of base 58 as for example through a living hinge, so that the dispenser can be easily loaded (hinges not shown). This will be explained in more detail in connection with FIG. 10. When the hinged side member is in the closed position formed by a snap fit or compression fit onto the primary triangular face member 59 and 60, a slit 63 is formed at the junction of the side members 61 and 62 for removal of a single sheet. The height of the dispenser is shown by h. First connecting means 30 is shown extending downwardly from base 58. Sheet material 14 is shown in the stored position within the dispenser with top sheet 40 extending through slit 63.

The width w of the dispenser is shorter in dimension than the width of any given sheet to be dispensed. For example, end wrap papers have a length of about $3\frac{1}{2}$ inches and a width of about 2 inches. A suitable dispenser for such material should have a length l of about $3\frac{1}{2}$ inches but a width of about 1 or $1\frac{1}{4}$ inches. This shorter width causes the sheets loaded in this container to distort upwardly, thus forcing an arched stack of interfolded sheets towards the slit 63. As each sheet is removed, this upward direction causes the next subadjacent sheet to be moved toward the slit in "spring-like" fashion for easy removal. The process continues until each sheet is removed. The height h of the dispenser conforms to the height of the distorted stack of sheet material thus allowing the top sheet to easily pass through the slit 63. For end wrap papers this height should be about 1 to $1\frac{1}{4}$ inches. The height h should not be so low that the stack is unduly distorted from its arched triangular configuration; i.e. it should not be bowed.

Figure 5:
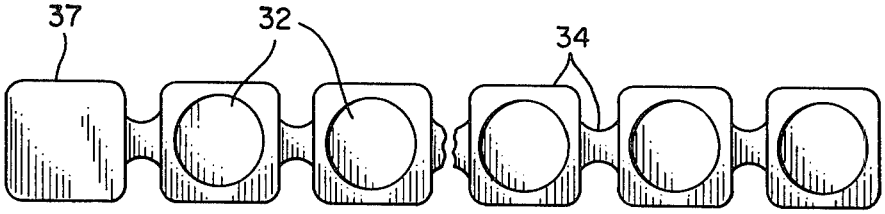
FIG. 5 is a plan view of the preferred embodiment of the wrist bracelet.
Figure 6:
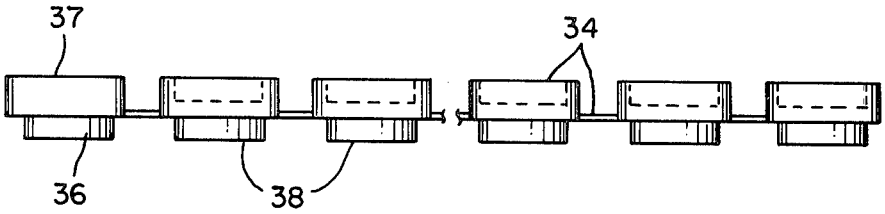
FIG. 6 is an end view of the preferred embodiment of the wrist bracelet.
Figure 10:
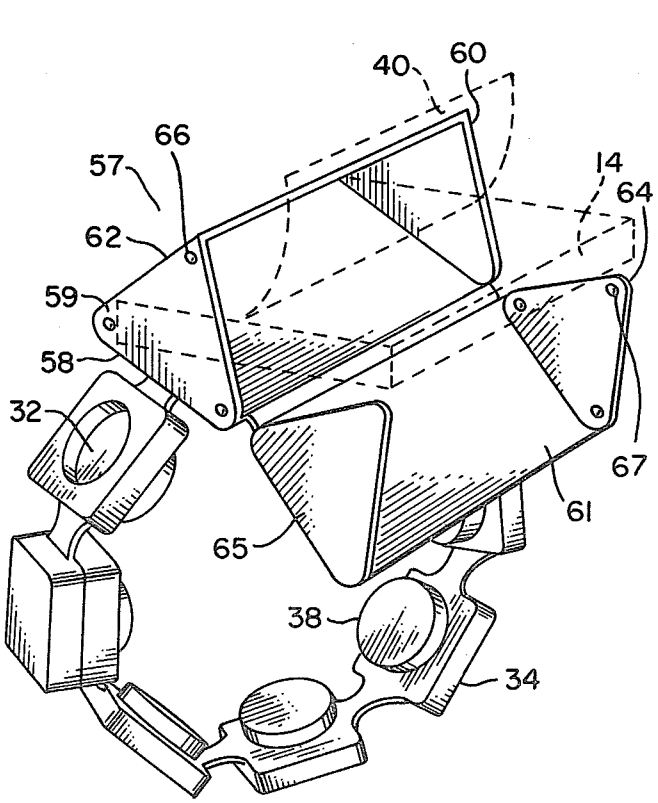
FIG. 10 is a view of the end wrap dispenser of FIG. 9 mounted on the bracelet of FIGS. 4, 5 & 6 showing the dispenser in the open position with a stack of end wrap paper being inserted.

FIG. 10 shows a triangular dispenser attached to bracelet 34 as shown in FIGS. 4, 5 & 6 and having side member 61 in the open position. Such triangular dispenser can also be used with the platform of FIG. 8. A stack of sheet material 14 (dotted lines) is shown in its position in the dispenser before loading. In the embodiment of FIG. 10, side member 61 also has mounted on each end thereof a pair of secondary triangular faces 64 and 65 which mate upon closing the dispenser with primary triangular face members 59 and 60.

Three circular protrusions 66 lie on the outside corners of primary triangular face 59 and three circular protrusions 67 lie on the inside corners of secondary triangular face 64. When the stack is placed inside the dispenser as shown and the side member 61 is closed, the stack distorts into the arched triangular configuration as shown in FIG. 9 and the inside surface of secondary triangular face members 64 and 65 coincide or mate with the outside surfaces of the primary triangular face members 59 and 60. The protrusions 66 of primary triangular face member 59 bear against the inside surface of secondary triangular face member 65 while the protrusions 67 of secondary triangular face member 64 bear against the outside surface of primary triangular face member 60 to retain said side member 61 in the closed position. By virtue of this closing means, the stack of sheets 14 are not pinched or distorted by the closing of the side member 61.

Although FIG. 10 shows three protrusions on each surface of a given face member, only one protrusion may suffice as long as it maintains the side member in a closed position. Moreover, one or more of such protrusions may be on either one or both of the outside surfaces of primary triangular face member 59 & 60 on one or both of the inside surfaces of secondary triangular face members 64 & 65.

The present invention has been described in relation to the preferred embodiments of the invention but certain variations substitutions and other changes should and will be apparent to those of ordinary skill in the art as falling within the scope of the foregoing specification.

I claim:

1. A device for individually dispensing a plurality of flexible sheets comprising, (a) a base member;

(b) a pair of primary triangular face members extending upwardly from opposite sides of said base member;

(c) a pair of side members each extending upwardly from said base member between and along the sides of said triangular face members, said side members substantially joining at the apex of each of said triangular face members to form a container of triangular cross-section having an opening between said side members for removal of a flexible sheet; at least one of said side members being hingedly attached to said base member for loading said container with sheets; wherein the width of said base is substantially less than the width of a flexible sheet and the perpendicular distance from said base to the apex of each of said triangular face members is sufficient to maintain said sheets stored within said container in a substantially arched triangular configuration;

(d) a solid projection extending outwardly from said base; and (e) a flexible member adapted to fit around at least a portion of the human arm having at least one recessed indentation adapted to accept said solid projection in close fit therewith.

2. The device of claim 1 wherein said base member and said triangular face members are formed as a unit.

3. The device of claim 1 wherein said at least one of said side members hingedly attached to said base member has a pair of secondary triangular face members mounted on each end thereof which coincide with said primary triangular face members when said side member is in the closed position; at least one of said secondary triangular face members having at least one protrusion located on the inside surface thereof, said protrusion bearing against the outside surface of the corresponding primary triangular face member when said side member is in the closed position to form a close fit therewith.

4. The device of claim 1 wherein said at least one of said side members hingedly attached to said base members has a pair of secondary triangular face members mounted on each end thereof which coincide with said primary triangular face members when said side member is in the closed position; wherein at least one of said primary triangular face members has at least one protrusion on the outside surface thereof said protrusion bearing against the inside surface of the corresponding secondary triangular face member when said side member is in the closed position to form a close fit therewith.

5. A device for individually dispensing a plurality of flexible sheets comprising;

(a) a base member;

(b) a pair of primary triangular face members extending upwardly from opposite sides of said base member; and (c) a pair of side members each extending upwardly from said base member between and along the sides of said triangular face members, said side members substantially joining at the apex of each of said triangular face members to form a closed container of triangular cross-section having an opening between said side members for removal of sheet material; at least one of said side members being hingedly connected to said base member for opening and closing said container, said at least one of said side members having a pair of secondary triangular face members mounted on each end thereof whose inside surfaces coincide with the outside surfaces of said primary triangular face members when said at least one of said side members is in the closed position; wherein the width of said base is substantially less than the width of sheet and the perpendicular distance from said base to the apex of each of said triangular face members is sufficient to maintain sheets stored within said container in a substantially arched-triangular configuration.

6. The device of claim 5 wherein said base member and said primary triangular face members are one unit.

7. The device of claim 5 wherein at least one of said secondary triangular face members has at least one protrusion located on the inside surface thereof said protrusion bearing against the outside surface of the corresponding primary triangular face member when said side member is in the closed position to form a close fit therewith.

8. The device of claim 5 wherein at least one of said primary triangular face members has at least one protrusion on the outside surface thereof; said protrusion bearing against the inside surface of the corresponding secondary triangular face member when said side member is in the closed position to form a close fit therewith.

9. The device of claim 5 wherein said flexible sheets are end-wrap papers used in cosemtology.

10. The device of claim 5 which further comprises a solid projection extending outwardly from said base.

11. The device of claim 10 which further comprises a flexible member adapted to fit around at least a portion of the human arm and having at least one recessed indentation adapted to accept said solid projection in close fit therewith.

12. The device of claim 10 which further comprises a platform member having at least one recessed indentation adapted to accept said solid projection in close fit therewith.

* * * * *